US007068131B2

(12) United States Patent
Liebetruth et al.

(10) Patent No.: US 7,068,131 B2
(45) Date of Patent: Jun. 27, 2006

(54) SWITCHING CONTACT ARRANGEMENT FOR A POWER SWITCH

(75) Inventors: Marc Liebetruth, Glienicke (DE); Sezai Türkmen, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 26 days.

(21) Appl. No.: 10/473,972

(22) PCT Filed: Mar. 28, 2002

(86) PCT No.: PCT/DE02/01250

§ 371 (c)(1),
(2), (4) Date: Mar. 31, 2004

(87) PCT Pub. No.: WO02/082481

PCT Pub. Date: Oct. 17, 2002

(65) Prior Publication Data

US 2005/0035835 A1 Feb. 17, 2005

(30) Foreign Application Priority Data

Apr. 4, 2001 (DE) ..... 101 17 844
Nov. 7, 2001 (DE) ..... 201 18 493 U

(51) Int. Cl.
*H01H 75/00* (2006.01)

(52) U.S. Cl. ..... 335/8; 335/195; 200/244

(58) Field of Classification Search ..... 335/8–10, 335/23–25, 132, 202, 165–195, 147; 200/244
See application file for complete search history.

(56) References Cited

U.S. PATENT DOCUMENTS

| | | | | |
|---|---|---|---|---|
| 4,709,127 | A * | 11/1987 | Adam | 218/20 |
| 4,996,507 | A * | 2/1991 | McKee et al. | 335/195 |
| 5,534,835 | A * | 7/1996 | McColloch et al. | 335/172 |
| 6,005,206 | A * | 12/1999 | Rakus et al. | 200/244 |
| 6,376,788 | B1 * | 4/2002 | Jones et al. | 200/244 |

FOREIGN PATENT DOCUMENTS

| | | |
|---|---|---|
| DE | 29923674 | 2/2001 |
| DE | 20100490 | 5/2001 |
| EP | 0222686 | 10/1986 |
| EP | EPO222686 | 10/1986 |
| EP | 0353940 | 7/1989 |
| EP | 0358287 | 9/1989 |

* cited by examiner

*Primary Examiner*—Lincoln Donovan

(74) *Attorney, Agent, or Firm*—Harness, Dickey & Pierce, P.L.C.

(57) ABSTRACT

A switching contact arrangement is for a power switch, wherein a plurality of contact levers are pivoted on a contact support via a bearing pin. The contact support is provided with at least three support elements for radially supporting the bearing pin. In order to simplify production of the contact support, at least three of the support elements are configured as a one-piece shaped element that forms the contact support. At least one of the support elements can have a metal element that is at least partially embedded in a plastic shaped element of the contact support. The metal element can be configured as a sheet metal part.

20 Claims, 3 Drawing Sheets

SWITCHING CONTACT ARRANGEMENT FOR A POWER SWITCH

This application is the national phase under 35 U.S.C. § 371 of PCT International Application No. PCT/DE02/01250 which has an International filing date of Mar. 28, 2002, which designated the United States of America and which claims priority on German Patent Application numbers DE 101 17 844.1 filed Apr. 4, 2001 and DE 201 18 493.1 filed Nov. 7, 2001, the entire contents of which are hereby incorporated herein by reference.

FIELD OF THE INVENTION

The invention generally relates to the field of electrical/power switches, and is preferably applicable to the design configuration of a rigid member which is used as a contact mount for a contact.

BACKGROUND OF THE INVENTION

In a known electrical switch of this type, in which two or more contact levers which form the contact are held on the contact mount by way of a bearing bolt such that they can pivot, the contact mount has at least three supporting elements in order to support the bearing bolt radially (E 0 222 686 B1). The contact mount in this case includes a metal frame, which is formed from two side walls and from two or more bolts which connect the side walls. The metal frame is hinged via a coupling bolt on an insulating coupling element, which is used for coupling the contact mount to a switch drive. Two of the supporting elements, which are associated with the ends of the bearing bolt, are in this case formed by the side walls of the metal frame.

In order to prevent undesirable radial bending of the bearing bolt for the contact levers with as little complexity in terms of additional material as possible, two intermediate bearings for this contact mount, which are arranged between adjacent contact levers in the axially central region of the bearing bolt, form additional supporting elements by being hinged on the coupling bolt. In this case, aperture openings are required for the contact mount, for the intermediate bearings to pass through to the coupling bolt. Supporting elements which are integrated in this way in addition to the two outer supporting elements in the contact mount must be positioned for installation of the bearing bolt, owing to their capability to pivot about the coupling bolt.

SUMMARY OF THE INVENTION

Against the background of an electrical switch, an embodiment of the invention is based on an object of simplifying the production and installation of the contact mount.

According to an embodiment of the invention, an object may be achieved in that at least three of the supporting elements are in the form of part of a molding which forms the contact mount and is produced integrally. For the purposes of an embodiment of the invention, the expression an integrally produced molding should be understood as being a part in which two or more functional elements are connected in the course of a molding process, such as a stamping, injection-compression molding, casting, injection molding, compression molding or sintering process, to form a single component which is assembled such that it cannot be disconnected for installation purposes.

In the case of a refinement such as this, the three supporting elements are integrated rigidly in a predetermined position in the contact mount, as part of it. In this case, the three supporting elements are actually aligned with the axis of the bearing bolt during the production of the contact mount so that no tilting of the bearing bolt caused by tolerance discrepancies will in practice occur during operation of the switch. A bearing bolt which is supported in this way is also subject to only a small maximum amount of bending when high short-circuit or surge currents occur, and thus has a good capability to withstand high short-circuit and surge currents.

The novel switching contact arrangement may have a large number of contact levers, which are each subject to an individual tolerance discrepancy from a given nominal size, and intermediate bearings, which are possibly likewise subject to an individual tolerance discrepancy from their nominal size, but which may be part of the contact levers, since the number of contact levers is subdivided into subsets. Each of these is arranged axially bounded between two adjacent supporting elements. This axial bounding of the subsets of contact levers limits any axial movement of the contact levers in one subset, owing to the current forces which act between them, to the axial section of the bearing bolt which is bounded by the respective supporting elements. The maximum amount of movement is not greater than the sum of all the individual tolerance discrepancies of the contact levers and of the intermediate bearings, which may be present, in this subset. This makes it possible to geometrically associate the contact levers with contact force springs such that their spring force is not reduced by bending or tilting. The geometrically accurate association between the contact force springs and the contact levers thus also contributes to increasing the capability of the switching contact arrangement to withstand short-circuit and surge currents.

If the molding is at least partially in the form of a plastic molding, then there is no need for the coupling bolt to have an electrically insulating configuration. The mechanical strength of a plastic molding such as this can be increased by embedding at least one reinforcement element at least partially in the plastic molding. A thermosetting plastic which, for example, has fiber reinforcement is typically used for the plastic molding and a nonmagnetic steel, for example, is used for the reinforcement element. As an alternative to this, other pure plastics or, for example, plastics reinforced by ceramic or glass fibers can also be used for the plastic molding, and other metals or metal sheets can be used for the reinforcement element.

One preferred refinement of the novel switching contact arrangement provides for at least one of the supporting elements to have a metal part which is at least partially embedded in the plastic molding.

A metal part such as this may be part of the reinforcement element, thus at the same time increasing the mechanical strength of that part of the contact mount which forms the supporting element.

If the metal part is in the form of a metal sheet, for example composed of nonmagnetic sheet steel, a first subregion of which, which has undercuts, is embedded in the plastic molding and a second subregion of which, which is provided with a hole for the bearing bolt, projects out of the plastic molding. This then advantageously allows the cross section of the supporting element to be reduced such that it is no broader than the distance between the contact levers that is required for separation of the contact levers and thus does not lead to any additional broadening of the contact mount.

A further advantageous refinement of the novel switching contact arrangement provides for supporting elements which contain the metal parts to be at a distance from the coupling element in the axial direction of the bearing bolt if the contact mount is coupled to a switching shaft, which can be rotated using a switch drive, via a metallic coupling element. This makes it possible to avoid accidental energizing and problems relating to the insulation between the contact mount and the switch drive, in a simple manner. In this refinement, the entire available material depth of the contact mount transversely with respect to the bearing bolt can be used for the rigid embedding of a first subregion of a supporting element which is in the form of a metal sheet.

If a holder for the shielding body is provided on at least one of the supporting elements for a contact mount which is equipped with the shielding body, then this provides additional support for the shielding body against the gas pressure which occurred during switching. In a refinement such as this, side mounting limbs, which rest on the contact mount, are designed to be smaller owing to the reduced load, or may possibly be omitted.

BRIEF DESCRIPTION OF THE DRAWINGS

The present invention will become more fully understood from the detailed description of preferred embodiments given hereinbelow and the accompanying drawings, which are given by way of illustration only and thus are not limitative of the present invention, wherein FIGS. 1 to 9 show a number of exemplary embodiments of the novel switching contact arrangement and wherein:

FIG. 1 shows a schematic section illustration of a low-voltage circuit breaker with a switching contact arrangement which comprises a stationary contact assembly and a moving contact assembly, FIG. 2 shows a moving contact assembly with a first embodiment of a contact mount which is at least partially in the form of a plastic molding, FIG. 3 shows a reinforcement element, which may be embedded in the plastic molding of the contact mount shown in FIG. 2, FIG. 4 shows a second embodiment of a contact mount which is at least partially in the form of a plastic molding, and in which supporting elements in the form of a metal sheet are partially embedded in the plastic molding, FIG. 5 shows a section illustration, transversely with respect to the direction of the bearing bolt, through the contact mount shown in FIG. 4, FIG. 6 shows a reinforcement element which may be embedded in the plastic molding of the contact mount in FIG. 4, FIG. 7 shows a section illustration, transversely with respect to the direction of the bearing bolt, through a contact mount with an embedded reinforcement element as shown in FIG. 6, FIG. 8 shows a further section illustration through the contact mount illustrated in FIG. 4 along the line A—A in FIG. 5, and FIG. 9 shows the contact lever mount as shown in FIG. 4 with a shielding body.

DETAILED DESCRIPTION OF THE PREFERRED EMBODIMENTS

Figure 1:
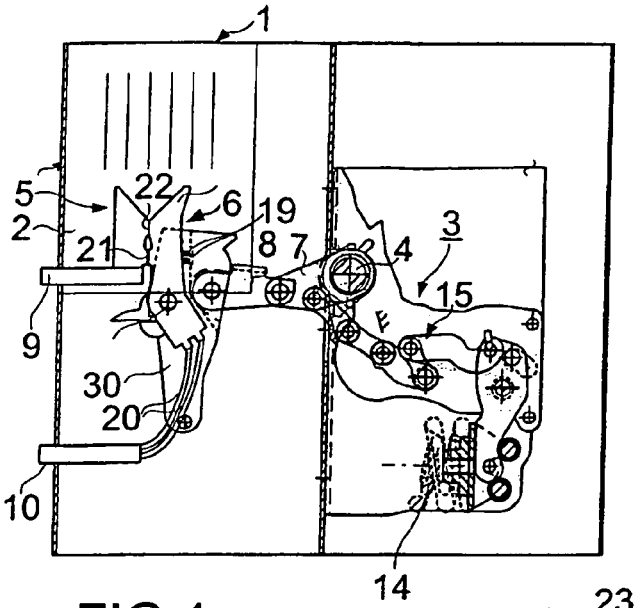

The electrical switch which is shown in FIG. 1 and is used in low-voltage power supply systems for voltage ranges up to about 1 000 V has a switch pole enclosure 1 in which switching chambers 2 are formed alongside one another, depending on the number of poles required. A switching shaft 4, which can be rotated by way of a switch drive 3, is used to operate the switching contact arrangement jointly, each of which includes a stationary contact assembly 5 and a moving contact assembly 6. For this purpose, two levers 7 which project radially from the switching shaft 4 (see FIG. 8) are coupled to a metallic coupling element which is hinged on the moving contact assembly 6. The contact assemblies 5, 6 are connected in a known manner to externally accessible connecting rails 9, 10. Two exemplary embodiments 6*a* and 6*b* of the moving contact assembly 6 will be explained in the following text with reference to FIGS. 2 and 3 and, respectively, FIGS. 4 to 9.

Figure 2:
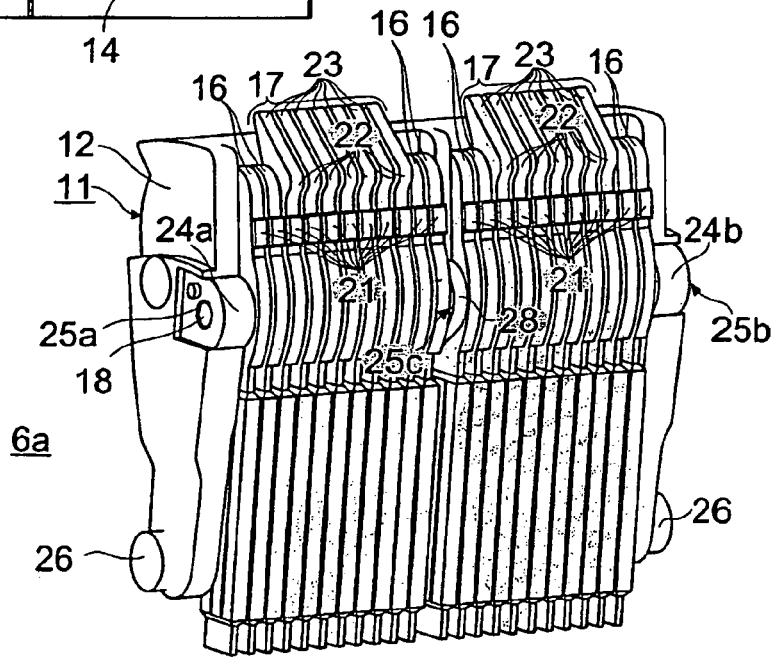
Figure 3:
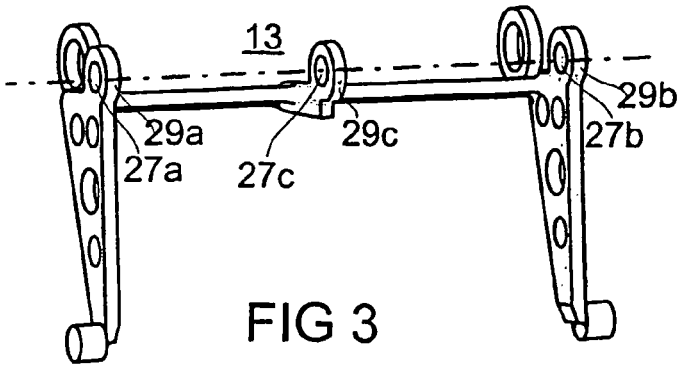

As can be seen in more detail from FIG. 2, the moving contact assembly 6*a* has a contact mount 11 which has a plastic molding 12 in the form of an integrally produced molding, which was formed in the course of a stamping process, with a reinforcement element as shown in FIG. 3 being embedded in it. The contact mount is mounted in the enclosure 1 (see FIG. 1) such that it can pivot, and can be moved via the switching shaft 4 and by use of the switch drive 3, of which FIG. 1 shows only one drive run 15 that is supported on a spring stalk 14 relative to the stationary contact assembly 5 to a connected position and to a disconnected position.

Two or more contact levers 16, 17, which are arranged parallel to one another, on the contact mount 11 can pivot relative to the contact mount 11 about a bearing bolt 18. Contact force springs 19 (see FIG. 1) ensure that the contact levers 16, 17 are prestressed in the direction of the stationary contact assembly 5. Flexible conductors 20 in the form of braids or strips are used for connecting the contact levers 16, 17 to the lower connecting rail 10 in such a way as to guarantee that the contact levers 16, 17 and the contact mount 11 can move without any impediment during the switching movements.

The number of contact levers 16, 17 which are fitted to the contact mount 11 depends on the magnitude of the current which the circuit breaker is intended to carry during operation. As can be seen from FIG. 2, of the total of 22 contact levers that are provided, 8 contact levers 16 are designed to be shorter and have only one contact area 21, which have no leading contact area 22 and no arcing horn 23 in the same way as the other contact levers 17.

During operation, all the contact levers are held between side pieces 24*a*, 24*b* of the contact mount 11, which point transversely with respect to the bearing bolt 18. These side pieces 24*a*, 24*b*, which are provided with holding openings 25*a*, 25*b* for the bearing bolt 18 form a first and a second supporting element for the ends of the bearing bolt, via which the bearing bolt is positioned axially and is supported radially. A part 29*a* or 29*b* of the reinforcement element 13 (see FIG. 3) can extend in each of these side pieces, and has an aperture 27*a* or 27*b*, respectively, for the bearing bolt. In the downward direction, the side pieces 24*a*, 24*b* merge into bearing arms 26 for the contact mount 11.

The relatively large width of the switching contact arrangement indicates that the section of the bearing bolt which runs between the two side supporting elements 24*a*, 24*b* is subjected to a relatively severe bending load when further forces in addition to the forces of the contact force springs 19 are caused by a heavy current, such as a short-circuit or surge current, when the switching contact arrangement is in the closed state.

Bending of this section of the bearing bolt is prevented by way of an additional, third supporting element, which supports the bearing bolt axially in the center. This third supporting element is formed by a contact mount rib 28, which is provided with a holding opening 25*c* (which cannot be seen in the figure) for the bearing bolt 18 and points transversely with respect to the bearing bolt, with a metal part 29*c* (which is completely embedded in the plastic molding 12 and has an aperture 27*c* for the bearing bolt) extending in the rib 28 and being part of the reinforcement element 13 (see FIG. 3).

Figure 4:
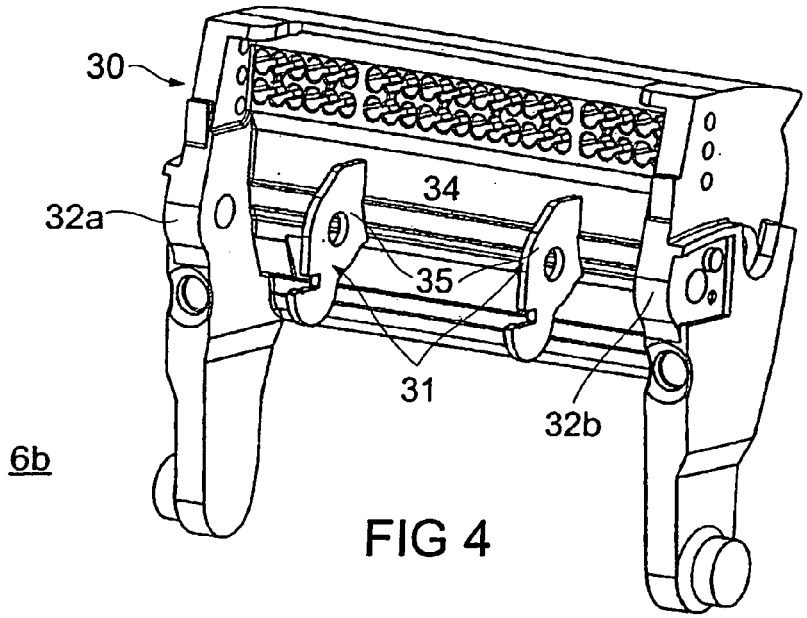

Of the second exemplary embodiment 6*b* of the moving contact group, FIG. 4 shows only a second embodiment 30 of the contact mount. In this contact mount 30, two supporting elements, which are in the form of metal sheets 31, are used to radially support that section of the bearing bolt which runs between two supporting elements that are in the form of side pieces 32*a*, 32*b*. A first subregion 33 of the two central supporting elements 31 is embedded in the plastic molding 34 of the contact mount 30, and together with a second subregion 35 of the two central supporting elements 31, projects out of the plastic molding.

Figure 5:
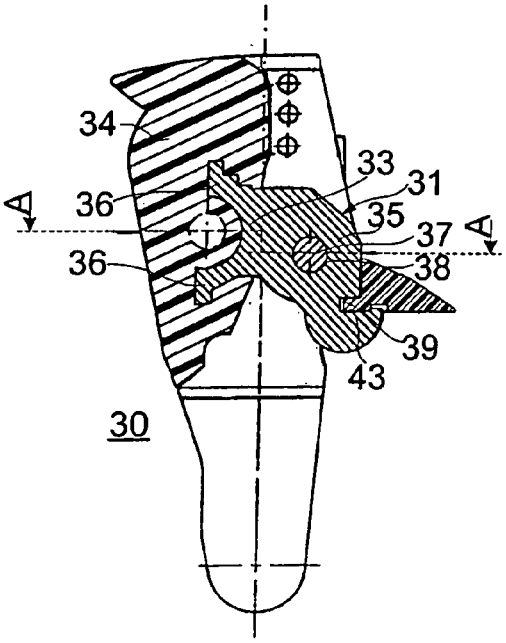
Figure 6:
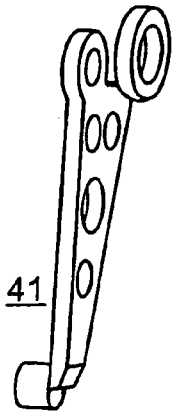
Figure 7:
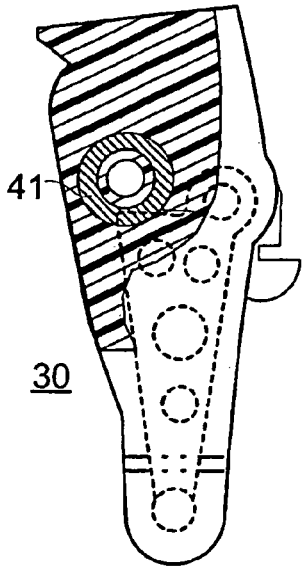

As can be seen in FIG. 5, the metal sheets 31 have undercuts 36 in the first subregion 33 which is embedded in the plastic molding, and these are used to anchor the respective metal sheet in the plastic molding securely even when the bearing bolt is subjected to a high bending load. The second subregion 35, which is provided with a hole 38 for the bearing bolt 37 to pass through, also has a recess 39, which is used to hold a shielding body 40 that is not shown in any more detail in FIG. 9. As is shown in FIG. 7, two reinforcement elements 41, 42 may be embedded in the plastic molding of the contact mount, and one of these is illustrated in FIG. 6.

Figure 8:
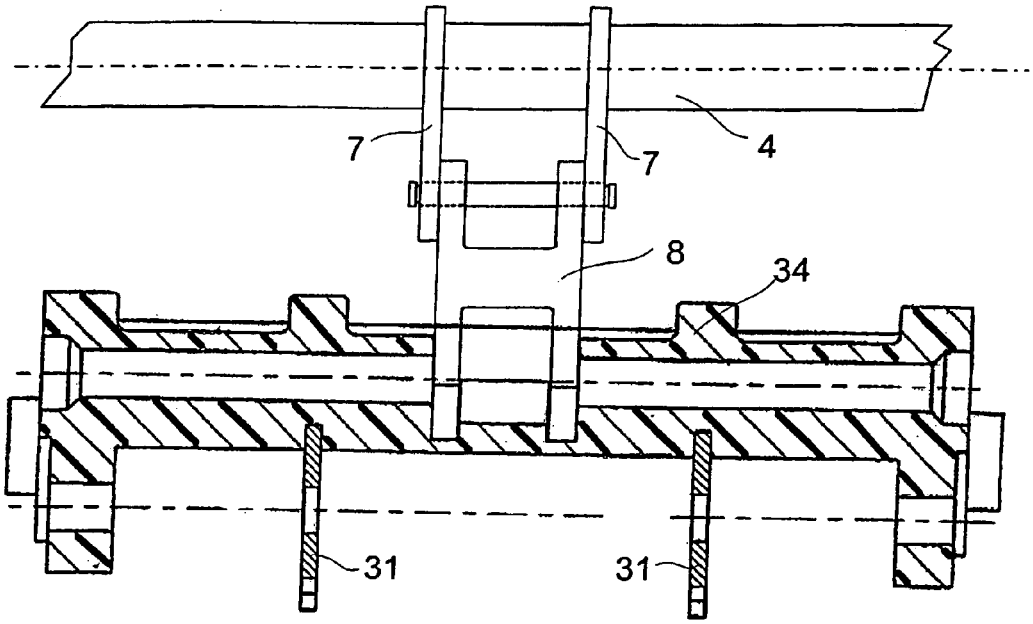

As can be seen from FIG. 8, the two metal sheets 31 are at a distance from the metallic coupling element 8 (see FIG. 1) in the axial direction, in order to avoid accidental energizing between the bearing bolt (which is at a low-voltage potential) of the contact levers and the metallic coupling element 8 (which is at ground potential), and thus the switch drive.

Figure 9:
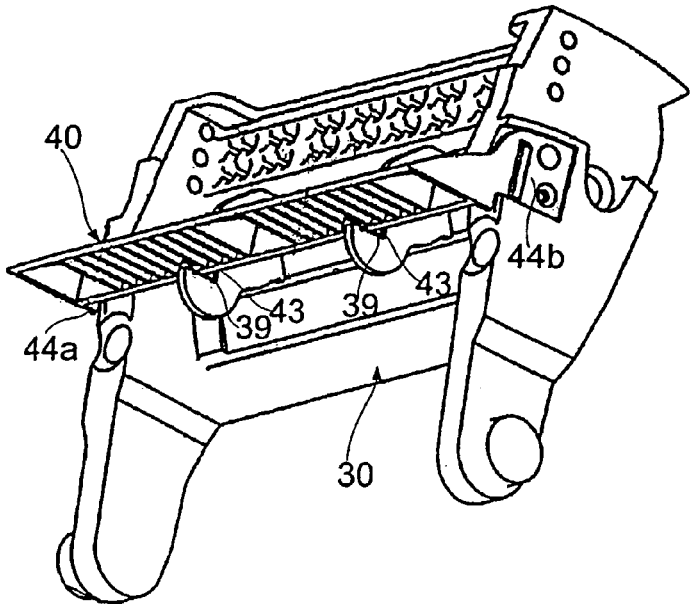

As can be seen from FIG. 9, tongues 43 are integrally formed on the shielding body 40, which protects the pivoting area of the contact mount 30 and further switch parts (which are not shown in any more detail but are arranged underneath the contact areas 21, 22 (see FIG. 1)) against erosion products that fall out and against condenser switching gases, and these tongues 43 engage in the recesses 39 which are provided on the metal sheets (see also FIG. 5). In consequence, the shielding body 40 is supported against the gas pressure which occurs during switching processes, in such a way that its mounting limbs 44*a*, 44*b*, which are held in the side on the contact mount, are less severely loaded.

Exemplary embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A switching contact arrangement for an electrical switch, comprising:

a contact mount;

at least two contact levers, pivotably attached to the mount via a bearing bolt; wherein the contact mount includes at least three supporting elements each provided with a holding opening for the bearing bolt, the at least three supporting elements radially supporting the bearing bolt, and wherein the at least three supporting elements are produced integrally in the form of at least part of a molding forming the contact mount.

2. The switching contact arrangement as claimed in claim 1, wherein the molding is at least partially in the form of a plastic molding.

3. The switching contact arrangement as claimed in claim 2, wherein at least one metallic reinforcement element is at least partially embedded in the plastic molding.

4. The switching contact arrangement as claimed in claim 2, wherein at least one of the supporting elements has a metal part which is at least partially embedded in the plastic molding.

5. The switching contact arrangement as claimed in claim 4, wherein the metal part is in the form of a metal sheet, a first subregion of which, including undercuts, is embedded in the plastic molding, and a second subregion of which, provided with a hole for the bearing bolt, projects out of the plastic molding.

6. The switching contact arrangement as claimed in claim 4, wherein, when the contact mount is coupled to a switching shaft via a metallic coupling element, the supporting elements which contain a metal part are at a distance from the coupling element in the axial direction of the bearing bolt.

7. The switching contact arrangement as claimed in claim 2, wherein when the contact mount is equipped with a shielding body on at least one of the supporting elements, a holder is provided for the shielding body.

8. The switching contact arrangement as claimed in claim 3, wherein at least one of the supporting elements has a metal part which is at least partially embedded in the plastic molding.

9. The switching contact arrangement as claimed in claim 8, wherein the metal part is in the form of a metal sheet, a first subregion of which, including undercuts, is embedded in the plastic molding, and a second subregion of which, provided with a hole for the bearing bolt, projects out of the plastic molding.

10. The switching contact arrangement as claimed in claim 5, wherein, when the contact mount is coupled to a switching shaft via a metallic coupling element, the supporting elements which contain a metal part are at a distance from the coupling element in the axial direction of the bearing bolt.

11. The switching contact arrangement as claimed in claim 8, wherein, when the contact mount is coupled to a switching shaft via a metallic coupling element, the supporting elements which contain a metal part are at a distance from the coupling element in the axial direction of the bearing bolt.

12. The switching contact arrangement as claimed in claim 9, wherein, when the contact mount is coupled to a switching shaft via a metallic coupling element, the supporting elements which contain a metal part are at a distance from the coupling element in the axial direction of the bearing bolt.

13. The switching contact arrangement as claimed in claim 3, wherein when there is a contact mount equipped with a shielding body on at least one of the supporting elements, a holder is provided for the shielding body.

14. The switching contact arrangement as claimed in claim 4, wherein when there is a contact mount equipped with a shielding body on at least one of the supporting elements, a holder is provided for the shielding body.

15. The switching contact arrangement as claimed in claim 5, wherein when there is a contact mount equipped with a shielding body on at least one of the supporting elements, a holder is provided for the shielding body.

16. The switching contact arrangement as claimed in claim 6, wherein when there is a contact mount equipped with a shielding body on at least one of the supporting elements, a holder is provided for the shielding body.

17. A switching contact arrangement for a switch, comprising:

at least two contact levers, pivotably attached to a contact support via a bearing pin, wherein the contact support includes at least three elements adapted to radially support the bearing pin, and wherein at least three of the elements are configured as a one piece shaped element forming the contact support; wherein the one piece element is at least partially formed as a plastic molding, at least one metallic reinforcement element is at least partially embedded in the plastic molding, at least one of the supporting elements includes a metal part which is at least partially embedded in the plastic molding, and the metal part is in the form of a metal sheet, a first subregion of which, including undercuts, is embedded in the plastic molding, and a second subregion of which, provided with a hole for the bearing pin, projects out of the plastic molding.

18. A switching contact arrangement for a switch, comprising:

at least two contact levers, pivotably attached to a contact support via a bearing pin, wherein the contact support includes at least three elements adapted to radially support the bearing pin, and wherein at least three of the elements are configured as a one piece shaped element forming the contact support; wherein the one piece element is at least partially formed as a plastic molding, at least one metallic reinforcement element is at least partially embedded in the plastic molding, at least one of the supporting elements includes a metal part which is at least partially embedded in the plastic molding, and when the contact mount is coupled to a switching shaft via a metallic coupling element, the supporting elements which contain a metal part are at a distance from the coupling element in the axial direction of the bearing pin.

19. The switching contact arrangement as claimed in claim 18, wherein when the contact mount is equipped with a shielding body on at least one of the supporting elements, a holder is provided for the shielding body.

20. A switching contact arrangement for an electrical switch, comprising:

a contact mount;

at least two contact levers pivotably attached to the mount via a bearing bolt; wherein the contact mount includes at least three supporting elements adapted to radially support the bearing bolt, the at least three of the supporting elements are produced integrally in the form of at least part of a molding forming the contact mount, and at least one of the supporting elements has a metal part, which is at least partially embedded in the molding.

* * * * *